US008393034B2

(12) United States Patent
Pichon et al.

(10) Patent No.: US 8,393,034 B2
(45) Date of Patent: Mar. 12, 2013

(54) APPARATUS FOR CLEANING A SUBMERGED SURFACE WITH EASY DRAINAGE

(75) Inventors: Philippe Pichon, Villenueve de Riviere (FR); Emmanuel Mastio, Fourquevaux (FR)

(73) Assignee: Zodiac Pool Care Europe, Paris (FR)

( * ) Notice: Subject to any disclaimer, the term of this patent is extended or adjusted under 35 U.S.C. 154(b) by 241 days.

(21) Appl. No.: 12/808,687

(22) PCT Filed: Dec. 17, 2008

(86) PCT No.: PCT/FR2008/052343

§ 371 (c)(1),
(2), (4) Date: Sep. 20, 2010

(87) PCT Pub. No.: WO2009/081040

PCT Pub. Date: Jul. 2, 2009

(65) Prior Publication Data

US 2011/0023247 A1 Feb. 3, 2011

(30) Foreign Application Priority Data

Dec. 21, 2007 (FR) ..... 07 09000

(51) Int. Cl.
*E04H 4/16* (2006.01)

(52) U.S. Cl. ..... 15/1.7; 210/167.16

(58) Field of Classification Search ..... 15/1.7; 210/167.1, 167.16, 167.17, 416.2, 459; 4/490, 4/496; 134/109, 110, 167 R, 168 R
See application file for complete search history.

(56) References Cited

U.S. PATENT DOCUMENTS

| | | | | |
|---|---|---|---|---|
| 5,245,723 | A * | 9/1993 | Sommer | 15/1.7 |
| 6,409,916 | B1 * | 6/2002 | Zelas et al. | 210/167.16 |
| 6,473,927 | B1 * | 11/2002 | Sommer | 15/1.7 |
| 2001/0032809 | A1 * | 10/2001 | Henkin et al. | 210/143 |
| 2002/0104790 | A1 | 8/2002 | Lincke | |
| 2004/0025268 | A1 | 2/2004 | Porat et al. | |
| 2008/0295264 | A1 * | 12/2008 | Hui et al. | 15/1.7 |

FOREIGN PATENT DOCUMENTS

| | | | |
|---|---|---|---|
| CN | 200710087378 | * | 4/2007 |
| WO | WO0250388 | | 6/2002 |
| WO | WO02092189 | | 11/2002 |

OTHER PUBLICATIONS

International Search Report in Application No. PCT/FR2008/052343.

* cited by examiner

*Primary Examiner* — Monica S. Carter
*Assistant Examiner* — Andrew A Horton
(74) *Attorney, Agent, or Firm* — Dean W. Russell; Kilpatrick Townsend & Stockton LLP

(57) ABSTRACT

Detailed is a device for cleaning an immersed surface including a body and members for driving this body over the immersed surface, a filtration chamber which has a liquid inlet and a liquid outlet, a hydraulic circuit for the flow of liquid between the inlet and the outlet through a filtering device, a handle for operating the body which allows a user to carry it in order to immerse it in the liquid or remove it from the liquid, wherein the liquid outlet is arranged at a longitudinal end of the body, and wherein the operating handle is connected to the body at an opposing end so that, when the body is suspended by the operating handle, it tilts spontaneously under the effect of gravity into an emptying position in which the liquid outlet is located below the liquid inlet.

5 Claims, 8 Drawing Sheets

APPARATUS FOR CLEANING A SUBMERGED SURFACE WITH EASY DRAINAGE

CROSS REFERENCE TO RELATED APPLICATIONS

Figure 1:
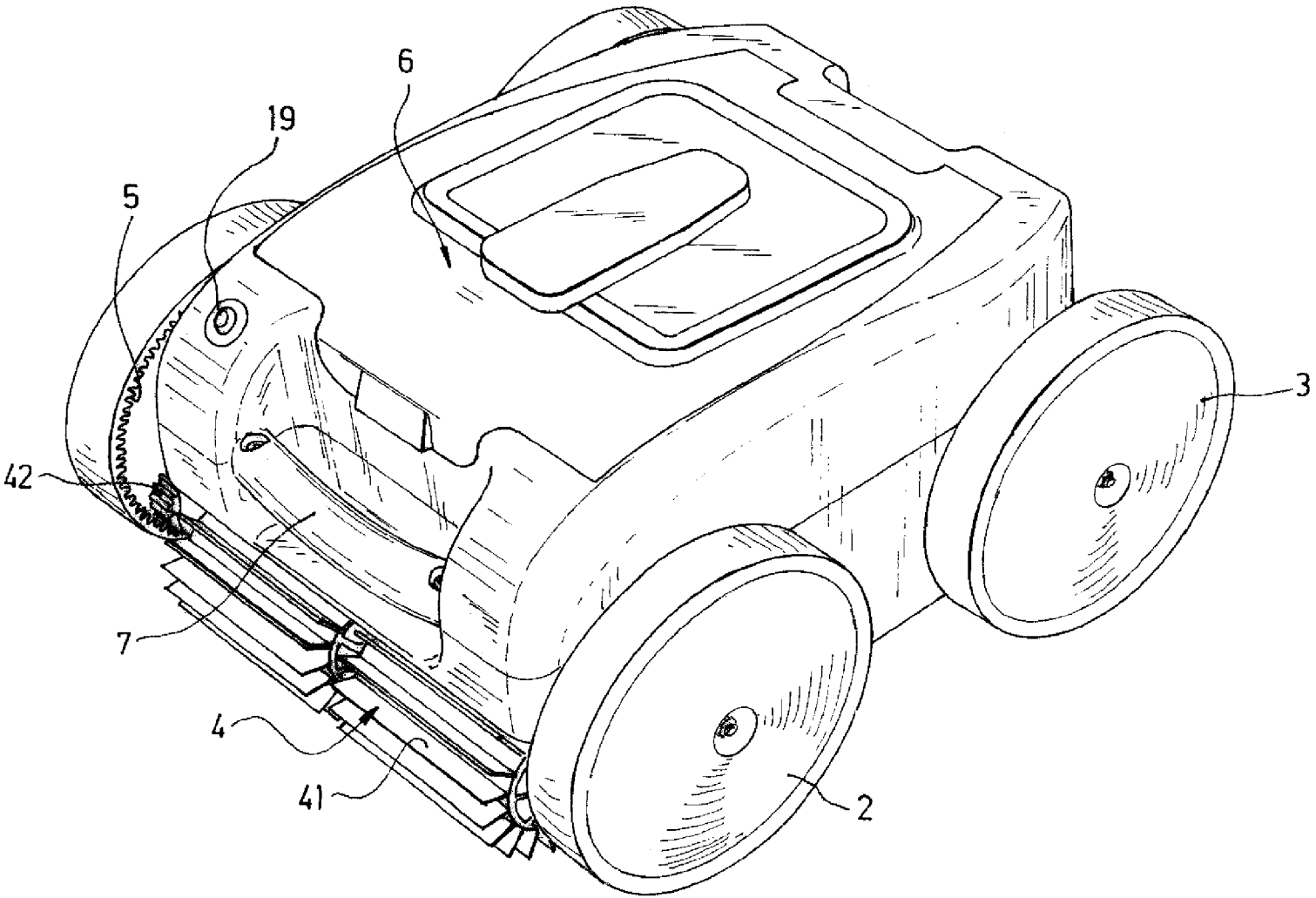

This application is the U.S. national phase of International Application No. PCT/FR2008/052343 filed on Dec. 17, 2008 and published on Jul. 2, 2009 as International Publication No. WO 2009/081040 A2, which application claims priority to French Patent Application No. 0709000 filed on Dec. 21, 2007, the entire contents of both of which are incorporated herein by reference.

The invention relates to a device for cleaning a surface which is immersed in a liquid, in particular a device for cleaning swimming pool walls.

A number of known swimming pool cleaning devices comprise:

- a hollow body and members for guiding and driving the body over the immersed surface in a main direction of advance, called the longitudinal direction,
- a filtration chamber which is provided in the body and which has:
- at least one liquid inlet into the hollow body, located at the base of the body,
- at least one liquid outlet out of the hollow body, located remotely from the hollow body,
- at least one hydraulic circuit which is capable of providing a flow of liquid between at least one inlet and at least one outlet through at least one filtering device, under the action of a motorized pumping device,
- a handle for handling the hollow body which allows a user to carry it in order to immerse it in the liquid or remove it from the liquid.

In these known devices with a motorized pump, the operating handle is generally articulated to the body in order to allow the device to be transported with the body held in the horizontal position which it occupies when traveling over the immersed surface in order to prevent in particular the debris contained in the filtering devices from being discharged via the liquid inlet(s) and/or outlet(s) when the device is removed from the liquid (cf., for example, US 2002/0104790, WO 0250388) in spite of the fact that the liquid inlets are generally provided with valves or other non-return devices.

Consequently, the weight of the device, after being removed from the liquid, is the sum of the weight of the device in the empty state and the weight of the volume of liquid contained in the device. This weight of the device, after it has been removed from the liquid, is therefore generally quite substantial, and in any case greater than the weight of the device in the empty state. It is therefore often the case that a user who, the first time the device is used, has successfully carried it to the pool to be cleaned, is no longer capable of subsequently removing this device from the pool owing to the additional weight caused by the presence of a residual volume of liquid in the device.

Furthermore, the operations for cleaning the filtering device assume that the hollow body is open when it is filled with liquid, which is particularly inconvenient and requires that the device be positioned in a location which is both capable of discharging this residual volume of liquid and the debris contained in the filtering device and remote from the pool cleaned by the device in order to prevent the debris from being returned to the pool.

Consequently, the removal of these devices from the liquid and the cleaning of the filtering device of these known devices are complex operations for users.

There are also devices which have liquid outlets which are dedicated to the emptying operation. Such devices have complex architectures and require that these dedicated outlets be provided with non-return devices, such as valves.

An object of the invention is to overcome all of these disadvantages by providing, for cleaning an immersed surface, a device for which the operations for handling, removal of liquid, transport, and cleaning the filtering device are facilitated and can be carried out rapidly with no complexity by a user.

At the same time, an object of the invention is to provide such a device whose cost is reduced and whose cleaning performance levels are equivalent to or even greater than the known cleaning devices.

The invention can be used for any swimming pool cleaning device of the type mentioned above, which may in particular be driven in an electrical, hydraulic or mixed manner.

However, an object of the invention is more specifically to provide such a device of the type which is self-propelled with (an) on-board electric drive motor(s).

To this end, the invention relates to a device for cleaning an immersed surface comprising:

- a hollow body and members for guiding and driving the body over the immersed surface in a main direction of advance, called the longitudinal direction,
- in the hollow body, a filtration chamber comprising:
- at least one liquid inlet into the hollow body, located at the base of the body,
- at least one liquid outlet out of the hollow body, located remotely from the base of the hollow body,
- a liquid pumping device,
- a hydraulic circuit which, when the pumping device is active, is capable of providing a flow of liquid between at least one liquid inlet and at least one liquid outlet, called the pumping outlet, through at least one filtering device,
- a member for handling the hollow body which allows a user to carry it in order to immerse it in the liquid or remove it from the liquid, wherein:

- at least one pumping outlet is arranged at a longitudinal end of the hollow body,
- the handling member is connected to the hollow body in such a manner that, when the hollow body is suspended by the handling member, it tilts spontaneously under the effect of gravity into an emptying position in which each pumping outlet is located below each liquid inlet to which it is connected via the hydraulic circuit,
- the hydraulic circuit is adapted so that, in a position for emptying the hollow body, the hollow body discharges the liquid which it contains exclusively via the pumping outlet(s).

A device according to the invention thus has two different positions: a normal operating position in which it moves over the immersed surface, the base of the hollow body being parallel with this immersed surface, each liquid inlet drawing in the liquid in the region of the surface, the liquid being conveyed through each pumping outlet, in particular via one or more pumping outlet(s) which is/are provided at a longitudinal end of the hollow body, after filtering by a filtering device; and an emptying position in which the handling member is held by a user, which tilts the device by means of gravity into an emptying position in which the pumping outlets are located below the liquid inlets, allowing the hollow body to be emptied automatically and at the same time as the device is removed. In this manner, when a user grips the handling member when the device is immersed in the liquid in order to remove it from the liquid, the device is positioned spontaneously in an emptying position and the liquid is removed from the hollow body as the device is removed from the liquid. Consequently, this removal operation is made particularly easy. Furthermore, after the device has been removed from the liquid, the weight thereof is limited to that of the components which it comprises and the debris which it contains. It can therefore be readily transported. It should be noted in this regard that the emptying position also corresponds to the position in which the device is transported, which is a particularly ergonomic position in so far as the hollow body extends at the side of the user. Furthermore, the cleaning of the device is also convenient to carry out since opening the device does not bring about any untimely flow of liquid.

All of the emptying of the device is carried out via the pumping outlets, that is to say, via the normal outlets of the device when it is operating over an immersed surface. That is to say, a device according to the invention has no outlets which are dedicated to the emptying operation. The device may comprise a single outlet which, when the pumping device is active, allows the filtered liquid to be discharged into the pool from which it originates and, when the pumping device is inactive and the device is raised by the handling member, allows the device to be emptied. A liquid outlet of a device according to the invention therefore has at least two functions, a function for discharging the filtered liquid during normal operation of the device and a function for emptying the liquid present in the device when the device is removed from the pool by the handling member. Consequently, a device according to the invention does not have any non-return device, such as valves.

In all the text, unless indicated otherwise, the cleaning device is described as it is arranged when it is operating over a horizontal immersed surface, so that the lower portions of the device are the portions of the device located in the region of the immersed surface, the upper portions of the device are the opposing portions, the front portions of the device and the rear portions of the device are defined relative to a preferred movement direction in the main direction of advance of the device over the immersed surface.

Advantageously and according to the invention, the hydraulic circuit which supplies each pumping outlet extends between at least one liquid inlet and this pumping outlet so as not to provide any significant space, called dead space, which is capable of retaining liquid—in particular more than 250 ml of liquid—when the hollow body is suspended via the handling member in the emptying position.

The handling member which allows the device to be carried in order to immerse it in the liquid or remove it from the liquid can be a member which is dedicated to handling the device, such as an operating handle which is connected to the hollow body of the device, or a member which further has another functionality, such as the wheels of the device, the liquid inlet of the device or the brushing device of the device.

However, advantageously and according to the invention, the handling member is an operating handle which is connected to the hollow body.

Such a member which is dedicated to handling the device can thus have an ergonomic shape which is specifically designed and adapted for gripping the device. This shape is not imposed by constraints linked to other functions in contrast to variants in which the handling member is formed by the wheels of the device, the brushing device of the device, etc.

The operating handle may be arranged on an upper portion of the device or at a longitudinal end of the device.

Advantageously and according to the invention, the operating handle is connected to the hollow body in such a manner that, in the emptying position, the longitudinal direction is generally vertical. In reality, the angle between the longitudinal direction and the vertical varies during the emptying of the device. This angle varies in accordance with the position of the center of gravity of the device and the position of the operating handle. The center of gravity of the device changes in accordance with the quantity of liquid in the device. Generally, however, the angle between the longitudinal direction and the vertical does not vary by more than 10° between the beginning of the emptying operation and the end of the emptying operation. This allows the device to be emptied in a rapid and efficient manner.

Advantageously and according to the invention, the operating handle is connected to the hollow body at a longitudinal end of the body opposite the pumping outlet(s).

The operating handle may be of any known type. For example, an operating handle of a device according to the invention may be articulated and may have different degrees of freedom relative to the hollow body in order to allow the hollow body to be tilted into the emptying position when it is gripped by a user. For example, such an operating handle can be fixed to the hollow body via a pivot connection which has an axis perpendicular relative to the longitudinal direction in order to allow the device to be tilted.

However, advantageously and according to the invention, the operating handle is rigidly fixed to the hollow body in accordance with a mechanical flush-fitting connection in such a manner that it has no degree of freedom relative to the hollow body.

When a user grips the operating handle of the device and removes the device from the liquid, liquid is progressively discharged from the device via the pumping outlets. Since the pumping outlets, after the device has been tilted into the emptying position, are below the liquid inlets, at least part of the liquid contained in the hydraulic circuit of the device is discharged.

Advantageously and according to the invention, the hydraulic circuit which supplies at least one pumping outlet extends between each liquid inlet and each pumping outlet in such a manner that it does not return to the longitudinal end of the hollow body opposite this/these pumping outlet(s).

According to this variant, all of the liquid contained in the hydraulic circuit is discharged.

In this manner, after the device has been completely emptied, there is no longer any active liquid, that is to say, liquid which has flowed in the hydraulic circuit between the liquid inlets and the liquid outlets and through the filtering devices so that it is possible to access the filtering device without any risk of encountering residual active liquid. It is thus possible, for example, to clean the filtering devices.

When the device is operating over the immersed surface, at least one pumping device provides the flow of liquid in each hydraulic circuit.

Advantageously and according to the invention, each pumping device which allows liquid to flow in the hydraulic circuit between each liquid inlet and each liquid outlet comprises at least one pumping motor which has a rotating drive shaft which is coupled to at least one pumping propeller which is interposed in at least one hydraulic circuit in order to generate a flow of liquid therein between each liquid inlet and each liquid outlet.

Such a pumping device not only allows the debris present on the immersed surface to be drawn in but also allows the device to be pressed on the immersed surface during its movements over the immersed surface.

The hollow body of a device according to the invention may be produced from several components which are joined together using any type of assembly means, or by a single component, such as a molded component.

Advantageously and according to the invention, the hollow body is formed principally by a generally concave housing which delimits a main chamber, this housing having openings which are provided at the base of the housing and remotely from the base of the housing at a longitudinal end of the housing, respectively, these openings forming the liquid inlet (s) and liquid pumping outlet(s), respectively.

Such a housing is, for example, formed in one piece by means of molding. Preferably, this housing is produced from a thermoplastic material which is capable of remaining in an aqueous medium for a long period of time. Such a material is, for example, an ABS plastics material which, owing to its constitution, has thermal resistance with respect to ageing, a capacity to withstand impacts and a strength which allows elements to be mounted in the housing and ease of molding.

Such a housing defines a main chamber which is capable of receiving at least one filtration chamber and at least one liquid pumping device.

Such a housing is moved by drive members. These drive members may be hydraulic drive members, electric drive members or mixed hydraulic and electric members.

However, advantageously and according to the invention, the members for driving the body over the immersed surface comprise at least one electric drive motor.

Such an electric motor may be an electric motor which is supplied with electrical power by one or more accumulators which are accommodated in the housing of the device or an electric motor which is supplied with electrical power from a domestic electric network, such as the urban electric network, via an electrical cable. Preferably, such an electric motor is a very low-voltage electric motor.

In the same manner, the pumping motor of each pumping device is preferably a very low-voltage electric motor. Each electric pumping motor may also be supplied with electrical power, either by accumulators which are accommodated in the housing or by means of a domestic electric network, such as the urban electric network, and an electrical cable which connects the device to this domestic electric network. Preferably, the electric motor for driving the cleaning device and each motor of each pumping device are supplied by the same source of electrical energy.

Advantageously, a device according to the invention comprises at least one axle which has non-guide wheels and which extends in a direction perpendicular relative to the longitudinal direction.

These non-guide wheels are advantageously caused to rotate by means of at least one electric drive motor. These wheels are mounted on an axle which extends in a perpendicular direction relative to the main direction of advance. A rotation of the wheels therefore brings about a movement of the robot in the main direction of advance.

According to a variant of the invention, this axle is arranged at the front of the device.

Advantageously and according to the invention, the members for driving the body over the immersed surface are unidirectional drive members.

A device according to the invention may further comprise a device which allows the movement direction of the device to be changed when it encounters a vertical wall. This device for changing direction may be of any known type.

Advantageously, a device according to the invention comprises a single liquid outlet which forms a single pumping outlet, a single liquid inlet and an operating handle which is connected to the body at a longitudinal end opposite the pumping outlet.

According to a variant of the invention, the liquid inlet is located at the rear of the front axle, close to the front axle.

Advantageously, a device according to the invention does not have any non-return valve, in particular in the region of the liquid outlets.

The invention further relates to a device for cleaning an immersed surface, characterized in combination by all or some of the features mentioned above or below.

Figure 2:
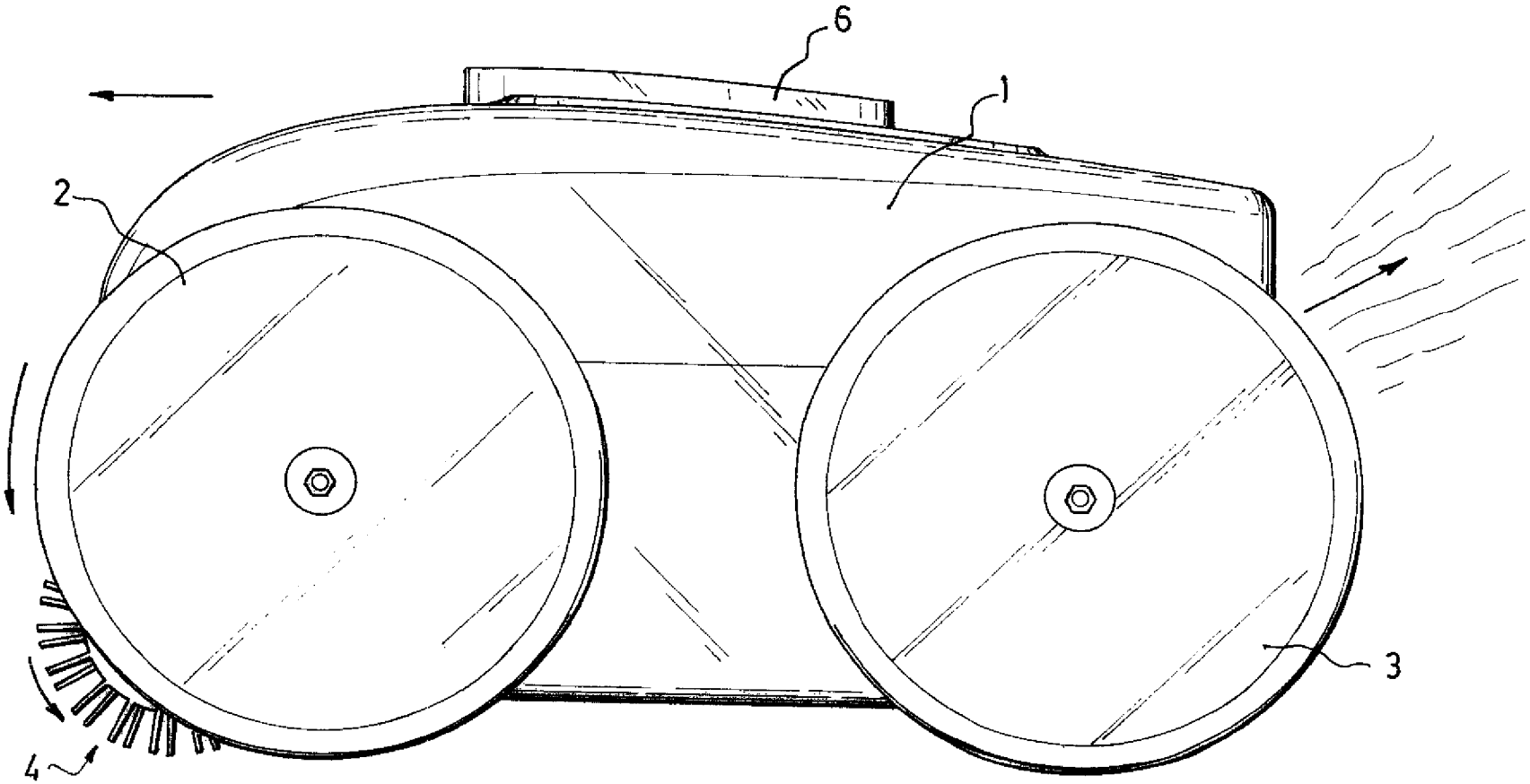
Figure 3:
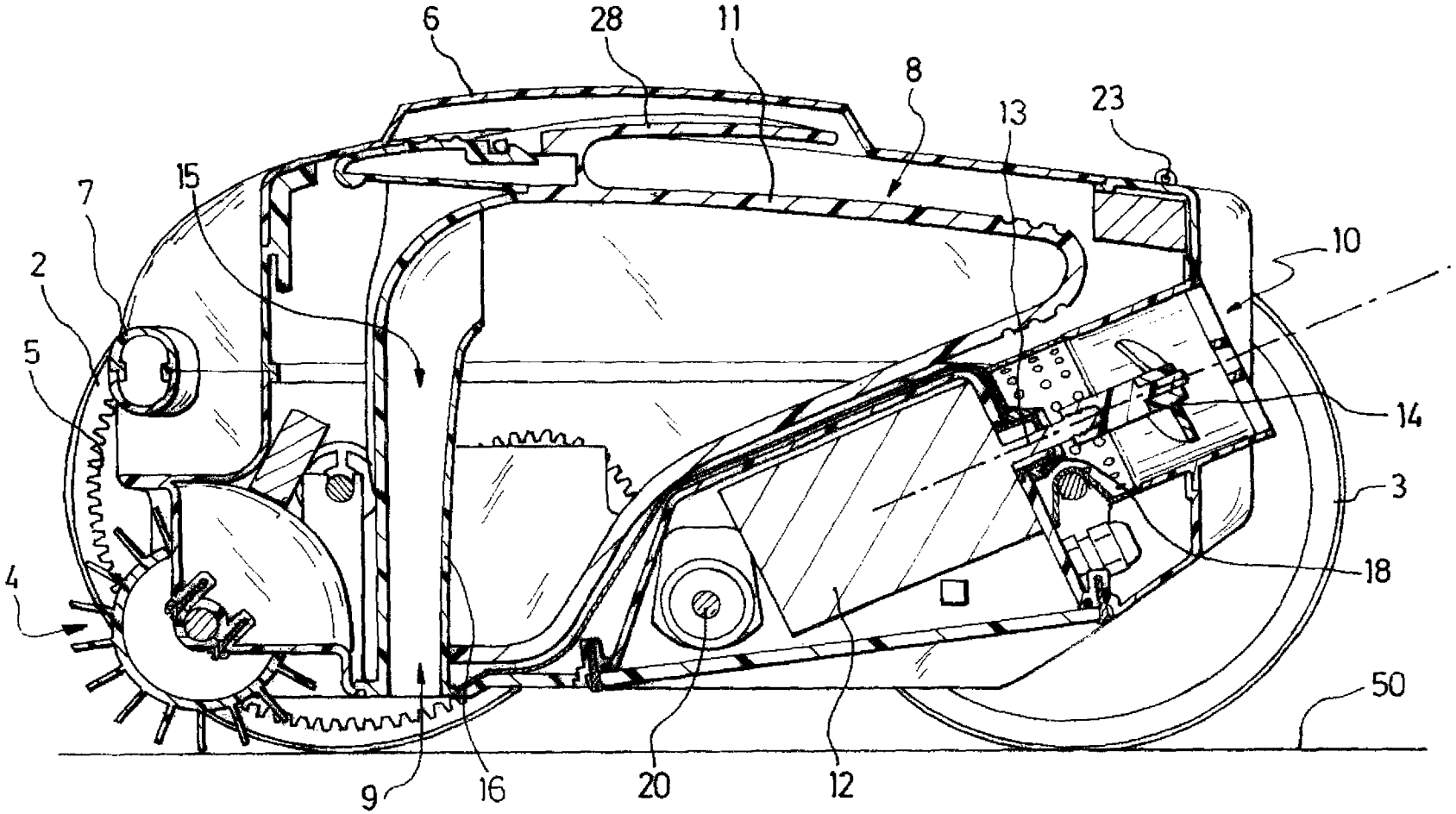
Figure 4:
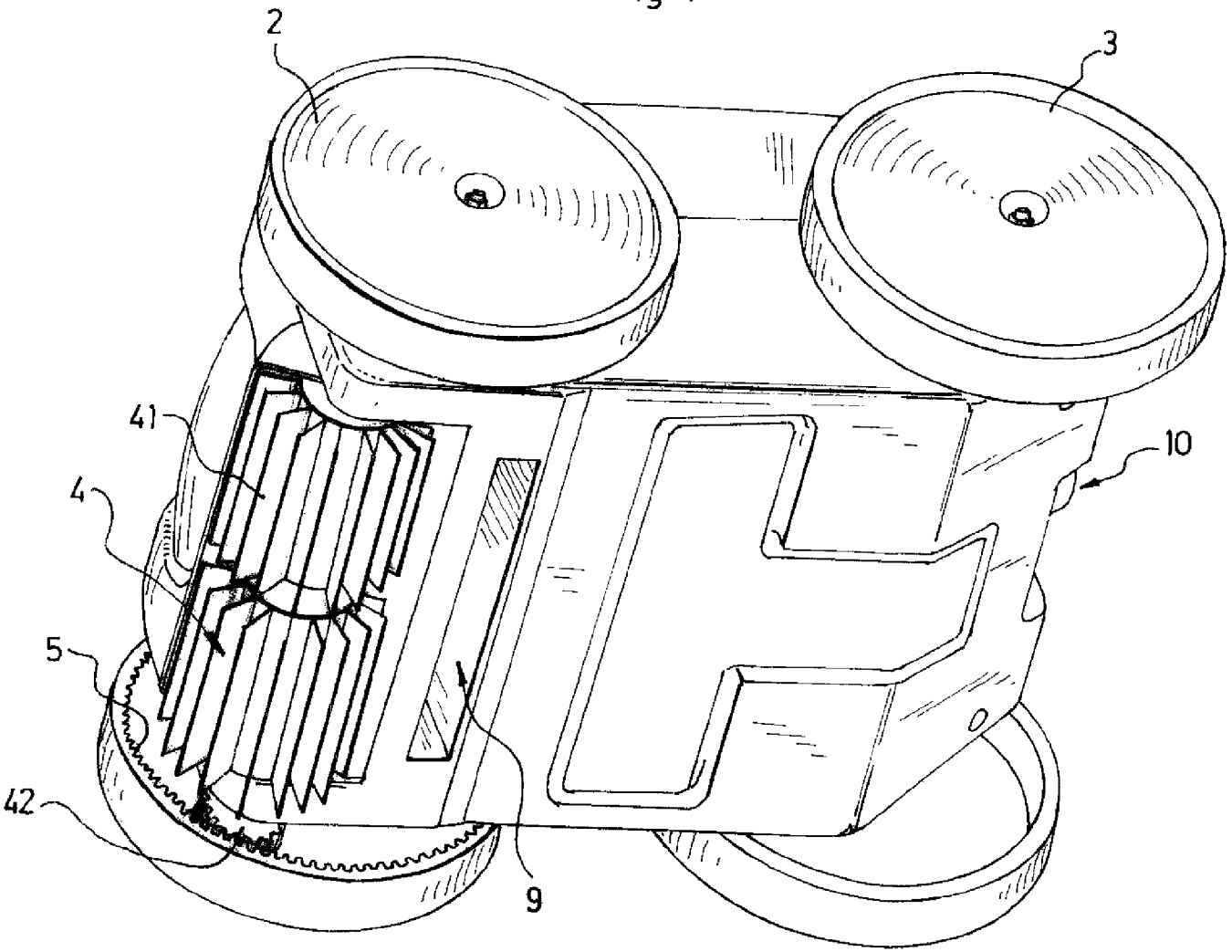
Figure 5:
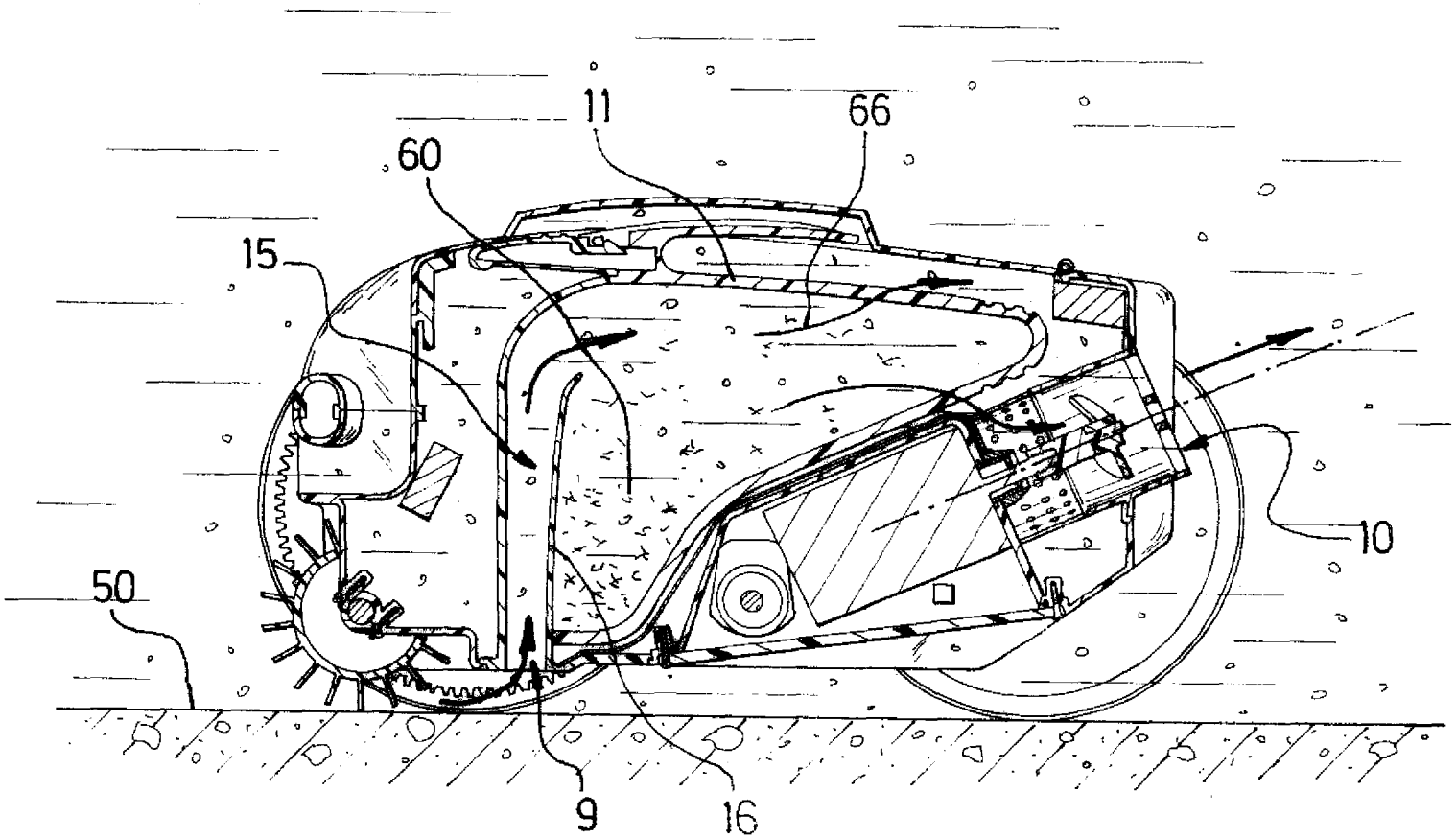
Figure 6:
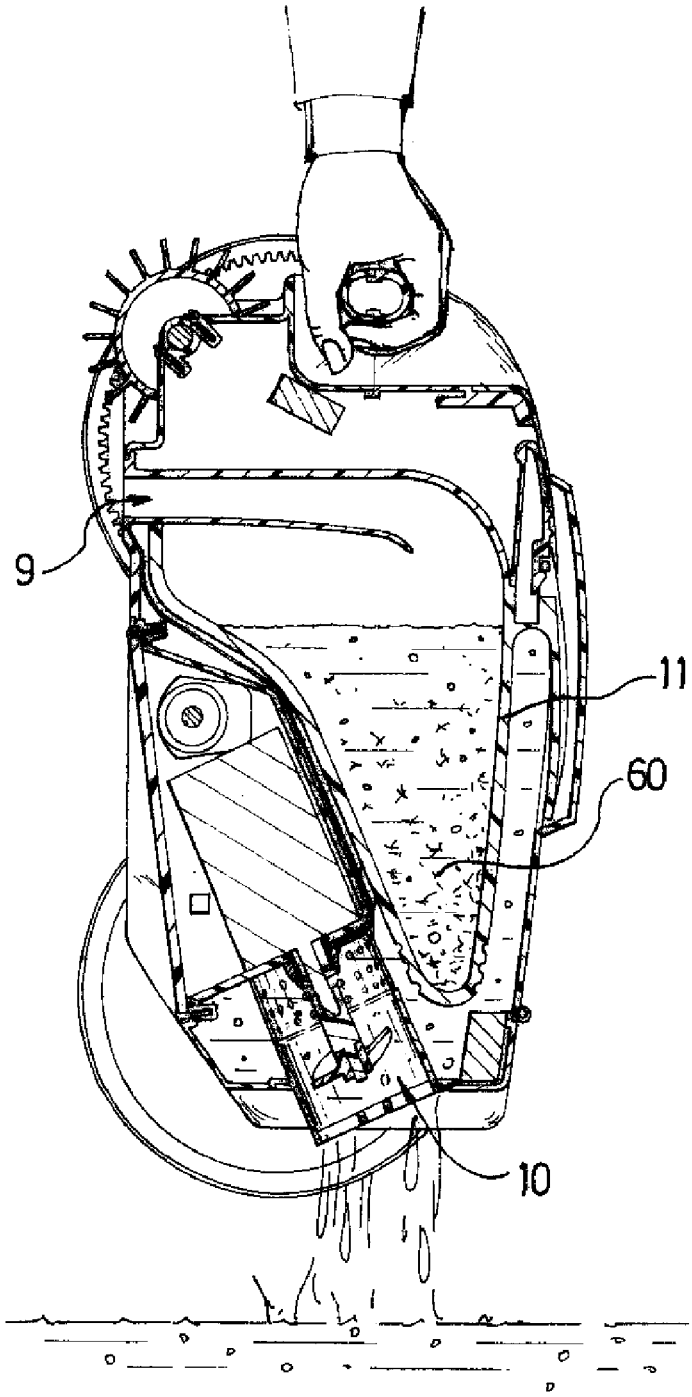
Figure 7:
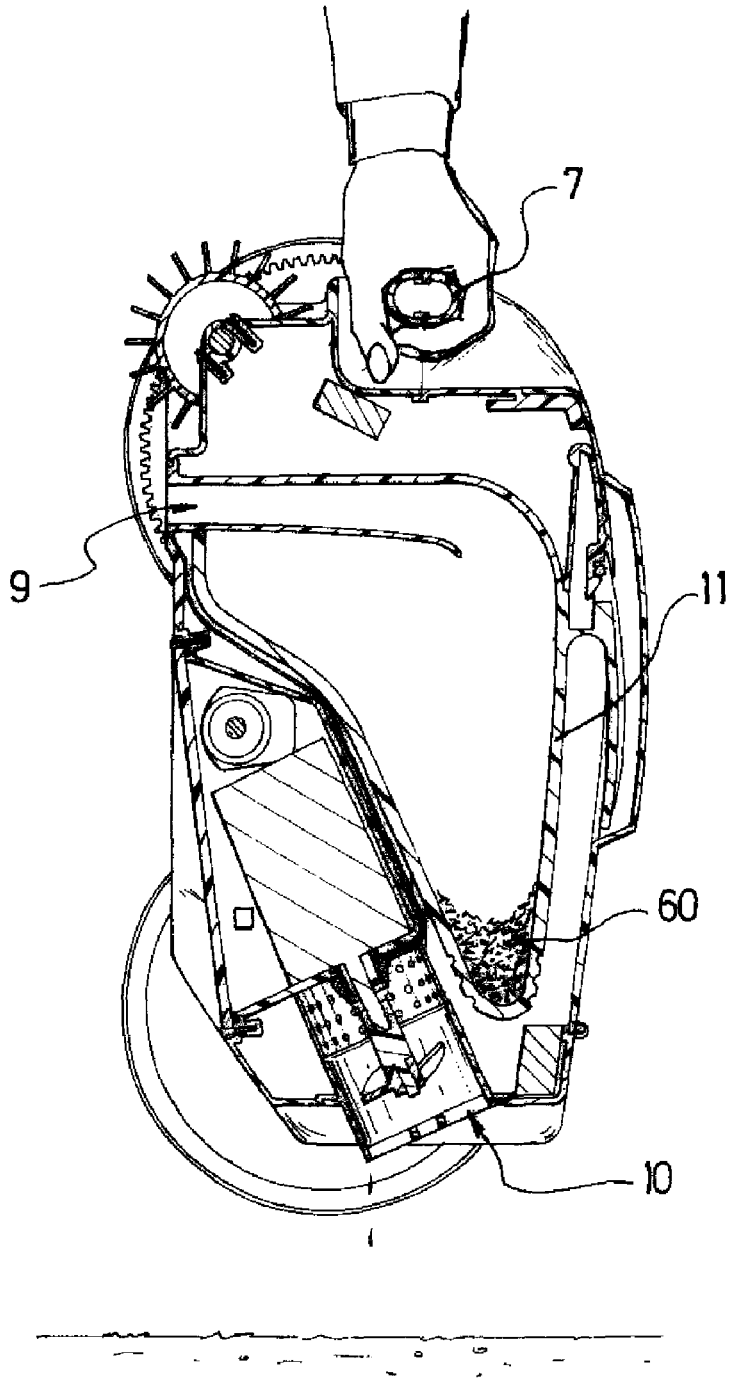
Figure 8:
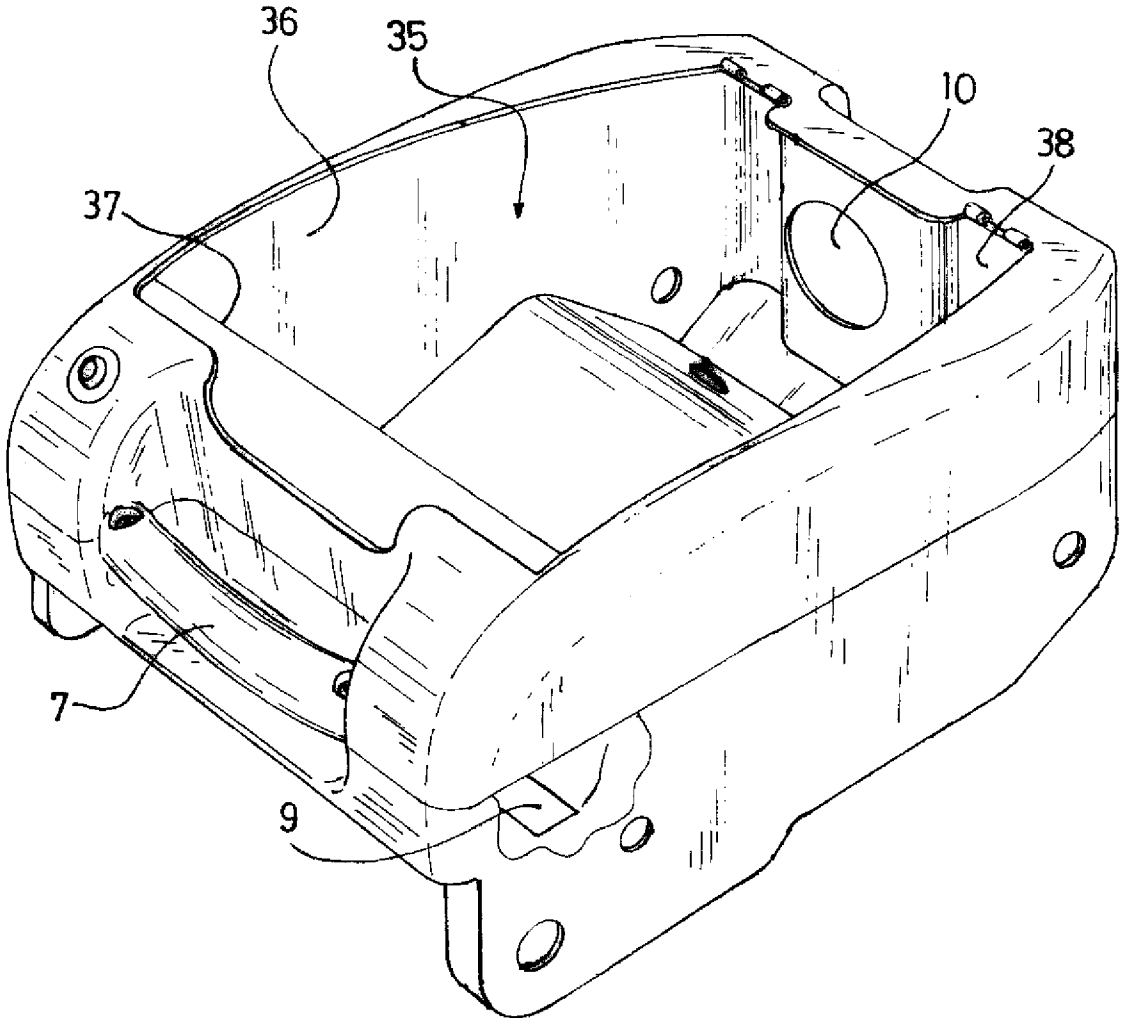

Other features, objectives and advantages of the invention will be appreciated from a reading of the following description which sets out by way of non-limiting example an embodiment of the invention, with reference to the appended drawings, in which:

FIG. 1 is a schematic perspective plan view of a cleaning device according to an embodiment of the invention, FIG. 2 is a schematic side view of a cleaning device according to an embodiment of the invention, FIG. 3 is a schematic section of a cleaning device according to an embodiment of the invention, FIG. 4 is a schematic perspective bottom view of a cleaning device according to an embodiment of the invention, FIG. 5 is a schematic section of a cleaning device according to an embodiment of the invention during the intake of debris on an immersed surface of a pool, FIG. 6 is a schematic section of the device of FIG. 5 which has been removed from the pool by an operator and is being emptied, FIG. 7 is a schematic view of the device of FIG. 6 in the completely emptied state, FIG. 8 is a schematic view of a housing of a device according to an embodiment of the invention.

In the Figures, the scales and proportions have not been strictly complied with for the purposes of illustration and clarity.

In all of the following detailed description with reference to the Figures, unless indicated otherwise, each component of the cleaning device is described as it is arranged when the device is moving normally over a horizontal immersed surface in a preferred direction of advance, relative to which the front and the rear of the device are defined.

A device according to the invention comprises a hollow body 1 and rolling members 2, 3, 4 for guiding and driving the hollow body 1 over an immersed surface in at least one preferred direction of advance and in a main direction of advance, called the longitudinal direction, parallel with the immersed surface.

This hollow body 1 is formed principally by a concave housing which delimits a main chamber. This concave housing is, for example, produced by means of molding or rotational molding. This housing is preferably produced from a thermoplastic material, such as polyethylene, polypropylene, ABS, PMMA or any equivalent material.

This hollow body 1 has a central chamber 35 which is capable of receiving a filtration chamber. This central chamber is delimited by a lower wall which extends in a substantially horizontal plane; by lateral walls 36 which generally extend in vertical planes; by a front wall 37 which generally extends in a vertical plane, orthogonal relative to the planes of the vertical lateral walls 36; and by a rear wall 38 which generally extends in a vertical plane orthogonal relative to the planes of the vertical lateral walls 36.

The lower wall has an opening which extends transversely in the region of the front wall 37 so that liquid can return to the central chamber 35 via this lower transverse opening. This opening forms a liquid inlet 9 in the hollow body 1.

The rear wall 38 comprises a cylindrical opening which forms a liquid outlet 10 out of the hollow body 1. This liquid outlet 10 which is provided in the rear wall 38 of the housing is longitudinally offset from the liquid inlet 9 which is provided in the lower wall. Furthermore, this liquid outlet 10 is provided in the upper portion of the housing in such a manner that it is also vertically offset from the liquid inlet 9.

As illustrated in particular in FIG. 3, this central chamber, this liquid inlet 9 and this liquid outlet 10 form a filtration chamber 8. This filtration chamber 8 further comprises a hydraulic circuit which is capable of providing a flow of liquid between the liquid inlet 9 and the liquid outlet 10 through a filtering device 11.

The liquid inlet 9 and the liquid outlet 10 are centered on the same longitudinal vertical center plane of the device.

The central chamber of the hollow body 1 is capable of receiving a filtering device 11. The filtering device 11 is arranged between the liquid inlet 9 and the liquid outlet 10.

This filtering device 11 may be of any known type.

For example, the filtering device 11 comprises a rigid frame and a filtering sheet—in particular a filtering material—carried by this rigid frame. Such a filtering device 11 is therefore self-supporting and can be readily handled by a user.

The device also comprises a flap 6 for access to this filtering device. This access flap 6 forms an upper wall of the hollow body 1 and covers it. In the embodiment illustrated, this flap 6 is provided on the upper portion of the device so that a person using the device can readily open the flap 6 and remove the filtering device 11. The access flap 6 is preferably articulated to the body 1 of the device by means of hinges 23 which are provided at the rear of the device.

Preferably, the filtering device 11 is a device which is mounted in the central chamber 35 of the housing 1 in the manner of a drawer. To this end, the rigid frame of the filtering device 11 has two ribs which extend laterally at each side of the filtering device 11. These ribs have shapes and dimensions which correspond to and complement the shapes and dimensions of grooves which are fixedly joined to the hollow body 1. These grooves which are fixedly joined to the hollow body 1 extend vertically along the inner faces of the vertical lateral walls of the hollow body 1. The ribs of the filtering device 11 are therefore capable of co-operating with the grooves of the hollow body 1 of the device.

In this manner, the removal of the filtering device 11 is the result of a translation movement of the filtering device 11 along the grooves of the hollow body 1. A user can therefore readily remove the filtering device 11 from the hollow body 1, for example, in order to clean it. After the filtering device 11 has been cleaned, a user can readily reintroduce the filtering device 11 into the hollow body 1 by orientating the filtering device 11 so that the ribs of the filtering device 11 are opposite the grooves of the hollow body, then by sliding the filtering device 11 in the hollow body 1.

The filtering device 11 further comprises a handle 28 which is provided on an upper portion of the filtering device 11 in order to facilitate handling of the filtering device 11. In particular, a user is able to readily assemble/disassemble the filtering device 11 using this handle 28 when the device is out of the liquid and resting on a horizontal surface.

In the preferred embodiment of the invention illustrated in the Figures, the rolling members for guiding and driving the device comprise a front axle which comprises front drive wheels 2, one at each side, and a rear axle which comprises rear non-drive wheels 3, one at each side.

Furthermore, preferably and as illustrated in the Figures, the device comprises brushes 4 which are arranged at the front of the device. These brushes 4 are intended to brush the immersed surface and move the debris which are brushed to the rear of the device in the direction of the liquid inlet 9 which is arranged below the device.

The device further comprises at least one electric motor 20 for driving the front drive wheels 2. Preferably, the device comprises two drive motors 20, one at each side, for independently driving each of the front wheels 2, respectively. To this end, each front wheel 2 has an internal toothed arrangement 5 which co-operates with a pinion 45 which is driven by the corresponding drive motor 20.

These brushes 4 may be of any type. According to an embodiment of the invention, the device comprises two front coaxial brushes 4. Each brush 4 is capable of being rotated about an axis which extends in a direction, called the transverse direction, perpendicular relative to the longitudinal direction. Each brush 4 comprises a plurality of fins 41 which extend radially from a brush shaft which forms the rotation axis of the brush 4. The fins 41 are, for example, of rubber or a strong plastics material.

Furthermore, the brushes 4 are preferably also rotated by at least one electric motor 20 for driving the front wheels 2 by means of a gear system. According to this embodiment, the internal toothed arrangement 5 of each front drive wheel 2 co-operates with a pinion 42 which is fixed to one end of the shaft of a brush 4 in such a manner that a rotation of the wheel 2 brings about, by means of the toothed arrangement 5 and the pinion 42, the rotation of the shaft of the brush 4, and therefore the rotation of the brush 4.

In this manner, in the embodiment illustrated, the rolling members are constituted by front drive wheels 2, rear non-drive wheels 3 and brushes 4 which are involved in driving and guiding the device over the immersed surface. In any case, the rolling members 2, 3, 4 have zones which are intended to come into contact with the immersed surface and which are coplanar and define a theoretical rolling plane 50. The longitudinal direction of advance of the device is parallel with this theoretical rolling plane 50.

The front wheels 2 preferably have a diameter of between 100 mm and 500 mm, in particular between 150 mm and 250 mm. According to the embodiment of the Figures, the front wheels 2 have a diameter in the order of 200 mm. In this manner, the front wheels 2 make it easier to overcome obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the device, in particular the hollow body, in order to form the extreme front portion of the device and first come into contact with an obstacle which is encountered during the forward movement.

Furthermore, according to the invention, as illustrated in particular in FIGS. 1, 6 and 7, the device comprises an operating handle 7 which is connected to the hollow body so that, when the hollow body 1 is suspended via this handle 7, the device tilts spontaneously under the effect of gravity into an emptying position in which the liquid outlet 10 is located below the liquid inlet 9.

Consequently, in the emptying position, the liquid present in the hydraulic circuit is removed entirely and spontaneously from the device.

The flow of liquid in the hollow body 1 of the device is illustrated schematically in FIG. 5 by means of arrows 66. Liquid enters the hollow body 1 via the liquid inlet 9 which is arranged below the device. This liquid passes into a liquid inlet column 15 in order to reach the filtering device 11. This filtering device 11 has porous walls which are capable of allowing the liquid to pass through but of retaining the solid debris 60. The filtered liquid reaches the liquid outlet 10 and is discharged at the rear of the device into the pool from which it originates.

The hydraulic circuit extends between the liquid inlet 9 and the liquid outlet 10 so that it has no significant space which is capable of retaining liquid when the hollow body 1 is suspended by the operating handle 7. Such an insignificant space corresponds, for example, to a quarter of a liter of liquid.

According to the preferred method illustrated in the Figures, the inlet column 15 forms a non-return wall 16 which prevents the debris which have reached the filtering device 11 from being discharged via the liquid inlet 9.

A device according to the invention further comprises a motorized liquid pumping device which comprises an electric pumping motor 12 which has a rotating drive shaft 13 which is coupled to a pumping propeller 14 which is interposed in the hydraulic circuit in order to generate therein a liquid flow between the liquid inlet 9 and the liquid outlet 10 connected by this hydraulic circuit.

The electric pumping motor 12 is accommodated in a sealed housing 17. This sealed housing 17 has an axial opening which allows the rotating drive shaft 13 to pass through. This opening is preferably sealed by means of an O-ring 18 which is arranged between the drive shaft 13 and the opening of the housing 17.

The electric pumping motor 12 is preferably supplied with electrical power by means of a sealed electrical cable which connects the device to a domestic electric network.

FIG. 1 illustrates the zone 19 where the electrical cable is introduced into the device. This cable for supplying electrical power to the pumping motor 12 is not illustrated in the Figures for the purposes of clarity.

The pumping motor may be of any known type. According to a preferred embodiment, the pumping motor 12 is a low-voltage motor.

As indicated above, the movement of the device according to the invention over the immersed surface to be cleaned is preferably provided by means of the front drive wheels 2. These front drive wheels 2 are rotated, for example, by means of at least one electric motor 20. This electric motor 20 is supplied with electrical power by the same electrical power supply cable as the pumping motor 12.

Preferably, each electric motor 20 is also arranged in the sealed housing 17 in which the pumping motor 12 is arranged.

Each electric motor is preferably a low-voltage electric motor.

FIG. 5 illustrates the device operating over an immersed surface of a pool. Debris 60 are drawn in by the device. These debris 60 are lodged in the filtering device 11.

FIG. 6 illustrates the device in the emptying position. To this end, a user has gripped the cleaning device by the operating handle 7 which has caused the device to tilt spontaneously under the effect of gravity into a position in which the liquid outlet 10 is located below the liquid inlet 9. Consequently, the liquid present in the device flows from the device via the liquid outlet 10. The debris 60 are retained inside the filtering device 11.

FIG. 7 illustrates the device in the emptying position when the liquid has been completely discharged from the device. It should be noted that the debris 60 are lodged in a corner of the filtering device 11. The user can then open the flap 6 and remove the filtering device 11 from the device in accordance with the principle described above, without any risk of encountering stagnant liquid in the device. The user can thus clean the filtering device 11 and in particular remove the debris 60 collected thereon. To this end, for example, the filtering device 11 can be made from two shells which are fitted to each other. A user, after having removed the filtering device 11 in one piece, can separate the two shells and remove the debris 60 from the shells.

Of course, the invention may have a number of construction variants and applications.

For example, according to an embodiment which is not illustrated in the Figures, the device may comprise a plurality of liquid inlets, a plurality of liquid outlets and a plurality of hydraulic circuits.

Furthermore, the sizing and the configuration of the device, in particular the hydraulic circuit thereof, are subject to an infinite number of variants. In addition, the invention can be used for a bi-directional device which is capable of backward movement.

The invention claimed is:

1. A swimming pool cleaner comprising:

a. a body comprising an inlet, a rear wall having an outlet, and a front portion opposite the rear wall;

b. a pumping device configured to cause water to flow from the inlet to the outlet;

c. a filtering device (i) positioned between the inlet and the outlet so as to filter water flowing therethrough and (ii) having an end proximate the outlet; and d. a handle connected to the front portion of the body; and in which the outlet and the filtering device cooperate such that, when the pumping device is inoperative and the body is oriented with the outlet below the inlet, substantially all of the filtered water above the end of the filtering device drains through the outlet.

2. A swimming pool cleaner according to claim 1 in which the handle is rigidly fixed to the front portion of the body in such a manner that it has no degree of freedom relative to the body.

3. A swimming pool cleaner according to claim 1 lacking any non-return valve.

4. A swimming pool cleaner according to claim 1 further comprising a member configured to guide the body along a surface of the pool.

5. A swimming pool cleaner according to claim 4 in which the member comprises an electric drive motor.

* * * * *